US009378639B2

(12) United States Patent
Brown et al.

(10) Patent No.: US 9,378,639 B2
(45) Date of Patent: Jun. 28, 2016

(54) TARGET IDENTIFICATION FOR SENDING CONTENT FROM A MOBILE DEVICE

(71) Applicant: GLOBALFOUNDRIES Inc., Grand Cayman (KY)

(72) Inventors: Martin Brown, Chandlers Ford (GB); Nicholas K. Lincoln, Stockbridge (GB); Jens D. R. Lundgren, Dyssegard (DK); Anthony P. Papageorgiou, Southampton (GB)

(73) Assignee: GLOBALFOUNDRIES Inc., Grand Cayman (KY)

( * ) Notice: Subject to any disclaimer, the term of this patent is extended or adjusted under 35 U.S.C. 154(b) by 2 days.

(21) Appl. No.: 14/546,460

(22) Filed: Nov. 18, 2014

(65) Prior Publication Data

US 2015/0138008 A1 May 21, 2015

(30) Foreign Application Priority Data

Nov. 21, 2013 (GB) ..... 1320538.0

(51) Int. Cl.
*G08C 23/04* (2006.01)
*G08C 19/28* (2006.01)

(52) U.S. Cl.
CPC ..... *G08C 23/04* (2013.01); *G08C 19/28* (2013.01)

(58) Field of Classification Search
CPC ..... G08C 23/04; G08C 19/28; G08C 2201/20
USPC ..... 341/173
See application file for complete search history.

(56) References Cited

U.S. PATENT DOCUMENTS

| | | | | |
|---|---|---|---|---|
| 8,391,719 | B2 | 3/2013 | Alameh et al. | |
| 2002/0045454 | A1 | 4/2002 | Iwata | |
| 2002/0065065 | A1 | 5/2002 | Lunsford et al. | |
| 2002/0173347 | A1 * | 11/2002 | Kinnunen ..... | H04M 1/6091 455/569.2 |

(Continued)

FOREIGN PATENT DOCUMENTS

| | | |
|---|---|---|
| EP | 1398987 | 3/2004 |
| EP | 1603289 | 12/2005 |

(Continued)

OTHER PUBLICATIONS

Anonymous, "Avago Technologies Introduces IrSimple Protocol Software for Instant High-Speed IrDA Transfer in Camera Phones and Other Mobile Devices," Jun. 4, 2013, pp. 1-2. Avago Publishing.

(Continued)

*Primary Examiner* — Edwin Holloway, III
(74) *Attorney, Agent, or Firm* — Heslin Rothenberg Farley & Mesiti P.C.

(57) ABSTRACT

A method for target identification for a connectable device is carried out at a mobile device. A sensor on a mobile device receives one or more infrared emissions from one or more infrared light sources, each light source being provided by a connectable device in an area. One or more processors in the mobile device analyze the one or more infrared emissions to determine a target connectable device at a target position in the area. The mobile device receives a blink pattern of infrared emissions from the target connectable device. One or more processors in the mobile device decode the blink pattern to determine a reference for the target connectable device to enable wireless connection by the mobile device to the target connectable device for data transfer.

16 Claims, 5 Drawing Sheets

(56) References Cited

U.S. PATENT DOCUMENTS

| | | | | |
|---|---|---|---|---|
| 2006/0136610 | A1 | 6/2006 | Lee et al. | |
| 2008/0214233 | A1* | 9/2008 | Wilson | H04M 1/7253 455/556.1 |
| 2010/0284380 | A1* | 11/2010 | Banerjee | H04W 16/14 370/338 |
| 2011/0128384 | A1* | 6/2011 | Tiscareno | H04B 10/1141 348/164 |
| 2013/0097525 | A1 | 4/2013 | Kim et al. | |
| 2015/0098706 | A1* | 4/2015 | Narendra | H04B 10/116 398/115 |

FOREIGN PATENT DOCUMENTS

| | | |
|---|---|---|
| GB | 2427101 | 12/2006 |
| WO | 2009105115 | 8/2009 |
| WO | 2011073821 | 6/2011 |

OTHER PUBLICATIONS

A. Wilson et al., "BlueTable: Connecting Wireless Mobile Devices on Interactive Surfaces Using Vision-Based Handshaking", ACM New York, NY, USA , GI '07 Proceedings of Graphics Interface, 2007, pp. 119-125.

* cited by examiner

TARGET IDENTIFICATION FOR SENDING CONTENT FROM A MOBILE DEVICE

BACKGROUND

This invention relates to the field of sending content to a target device from a mobile device. In particular, the invention relates to target identification when sending content to a target device from a mobile device.

Currently if a user of a mobile device wants to send content or messages from the mobile device to another device (for example, sharing visuals with a screen or music with a HiFi, etc.) they have to tell the device manually which consumer to target. This is usually achieved by picking an identifier (ID) of the intended target from a list of targets that the mobile device can currently connect to.

There are two problems with this. The first is that is that the user has to know the ID of their intended target and that is often not the case (for example, with conferencing facilities, etc.). The second is that the user has to pick from a list of connectable device ID's and, in some venues, this list may be large and so this search may take some time and is error prone.

It is known to display a target device's connection identifier as a Quick Response (QR) code on the device. This however has drawbacks. A user must be at a close range to the QR code and therefore the device in order to scan a QR code. Also, a QR code is an obtrusive unsightly label to have to display on a device. Finally, it is hard to change a QR code once it is printed so the device owner cannot set a target device ID of their choosing and is unable to change the code easily once it is displayed. These leads to problems of uniqueness.

Traditional high frequency (HF) infrared (IR) technology is used to send commands between devices, for example, from a television remote control to the television. It consists of an IR light-emitting diode (LED) on the remote that blinks at many thousands of times a second to communicate long bit patterns quickly (many bytes in a fraction of a second) to the television which receives them via a light dependent resistor (LDR).

This allows a high bit rate because the LDR is a simple component that changes its resistance when IR light hits the sensor. The resistance of an LDR can be sampled at many thousands of times a second (kHz) and therefore can receive signals from LEDs with high frequency modulation rates. This technique can also be used to transfer small amounts of data, for example old mobile phones used to use this technology to exchange contact details or "business cards".

The problem with using this technology to communicate connection information for a device is that an LDR only determines whether or not light is hitting the sensor (i.e. it is either on or off). It provides no information of where the light source is in relation to the sensor or the device (for example, light can often bounce of walls and round corners and can still be received) and it is useless if there is more than one IR source in range since they will interfere with each other.

Therefore, there is a need in the art to address the aforementioned problems.

SUMMARY

In an embodiment of the present invention, a method and/or computer program product for target identification for a connectable device is carried out at a mobile device. A sensor on a mobile device receives one or more infrared emissions from one or more infrared light sources, each light source being provided by a connectable device in an area. One or more processors in the mobile device analyze the one or more infrared emissions to determine a target connectable device at a target position in the area. The mobile device receives a blink pattern of infrared emissions from the target connectable device. One or more processors in the mobile device decode the blink pattern to determine a reference for the target connectable device to enable wireless connection by the mobile device to the target connectable device for data transfer.

In an embodiment of the present invention, a system for target identification for a connectable device is provided at a mobile device. The system comprises: a sensor for receiving one or more infrared emissions from one or more infrared light sources, each light source being provided by a connectable device in an area; a light analyzer for analyzing the one or more infrared emissions to determine a target connectable device at a target position in the area; a sensor data receiver for receiving a blink pattern of infrared emissions from the target connectable device; and a pattern decoder for decoding the blink pattern to determine a reference for the target connectable device to enable wireless connection by the mobile device to the target connectable device for data transfer.

BRIEF DESCRIPTION OF THE SEVERAL VIEWS OF THE DRAWINGS

The subject matter regarded as the invention is particularly pointed out and distinctly claimed in the concluding portion of the specification. The invention, both as to organization and method of operation, together with objects, features, and advantages thereof, may best be understood by reference to the following detailed description when read with the accompanying drawings.

Preferred embodiments of the present invention will now be described, by way of example only, with reference to the following drawings in which.

DETAILED DESCRIPTION

Figure 1:
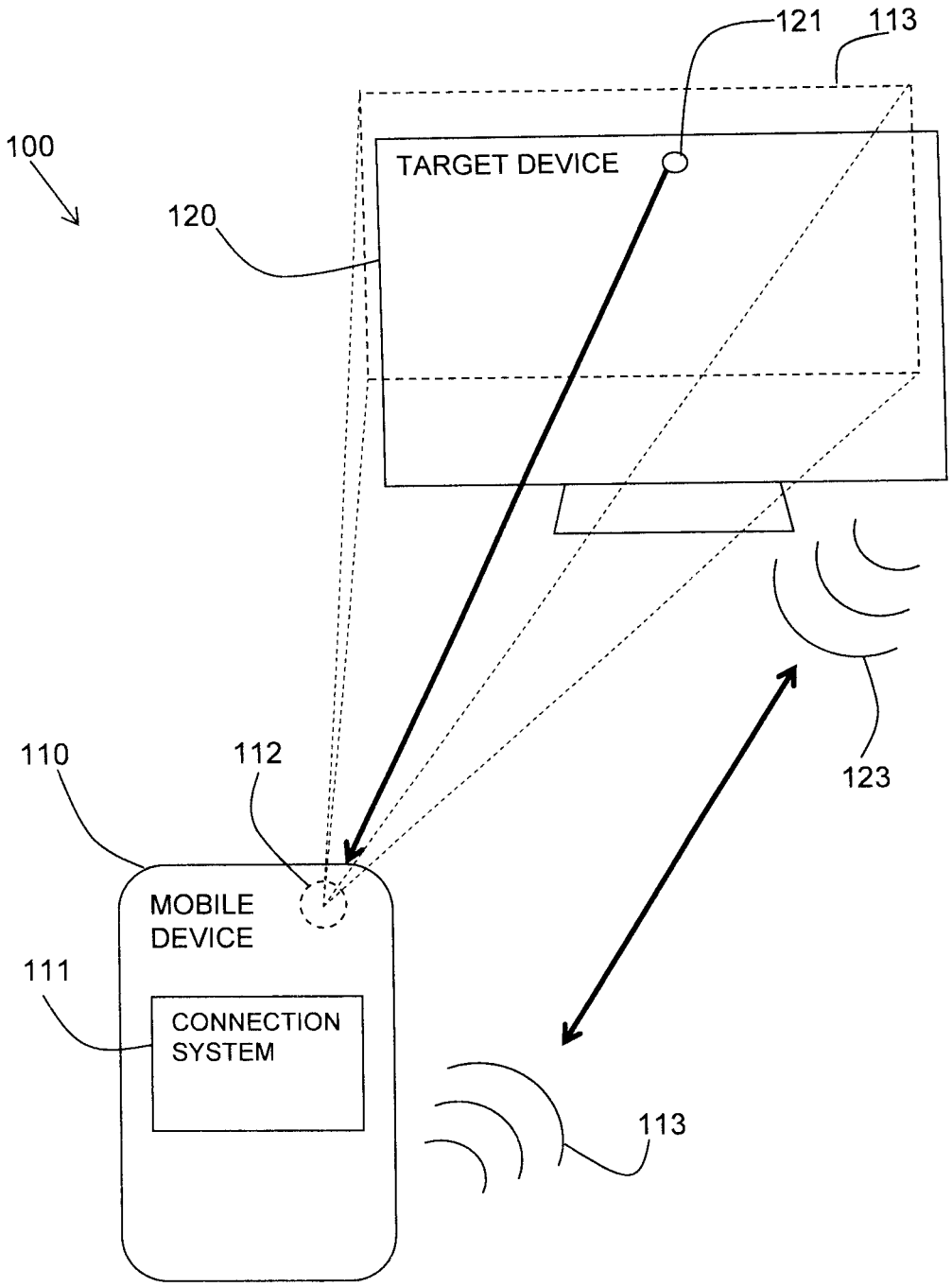
FIG. 1 is a schematic diagram of an example embodiment of a system in accordance with the present invention.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numbers may be repeated among the figures to indicate corresponding or analogous features.

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The described method and system enable an intended target device for wireless content sharing to be identified by a mobile device by pointing the mobile device at the intended target. The method by which this can be achieved is through using an infrared (IR) light emitter or source such as a light-emitting diode (LED) mounted on a prominent/visible location on a target device, such as a screen, which provides a blink pattern in the form of a sequence of on/off blinks of the light to indicate the target device's identity.

In a simple embodiment, the blink pattern may be an encoding of the target device's ID. In another embodiment, details of the blink pattern may be broadcast with the target device's ID. Either way the mobile device has a way of matching blink patterns to connectable target device IDs.

When an application on the mobile device wants to connect to a target device it prompts the user to point the mobile device's camera at the intended target. Since digital cameras can see IR light (provided it does not have an IR filter), it can see the blinking LED on the target device.

A simple threshold filter may be used to take the raw data feed from the camera and remove any non-IR data and then make any pixel below a certain intensity black and above it white. This allows the LED to be clearly identified.

Once an LED has been identified in the view, the application may use the blink pattern to determine which target device the user is intending to connect with and can proceed to connect to it in the usual way.

High frequency (HF) infrared (IR) transmission as known from traditional IR ports may be used to broadcast a connectable device ID. To be able to determine the location of an IR source in a scene and be able to identify and differentiate multiple sources, a sensor is required that can give a 2D image of a scene so x,y coordinates for each source can be obtained. The more complex the data that a sensor provides the longer it takes to sample and so the sample rate decreases. A charge-coupled device (CCD) or complementary metal-oxide-semiconductor (CMOS) sensor found in a typical mobile device only samples at around 30 Hz, therefore a lower frequency LED source is required than traditional HF IR.

Referring to FIG. 1, a diagrammatic representation of an example embodiment of the described system 100 is shown. A mobile device 110 is shown which requires connection to a target device 120 (shown in this example as a television).

The target device 120 may include an IR light emitter 121, which emits a blink pattern of light. The IR light emitter 121 may be an IR LED. The IR LED may be of the form used with HF IR technology with the difference that the modulation of the blink pattern is at a lower frequency in order to be able to be received by the sensor 112.

The mobile device 110 includes a connection system 111 for connection to a target device and a sensor 112 for sensing the blink pattern of light from the IR light emitter 121. The sensor 112 may be an existing camera sensor of a mobile device 110 or it may be a separate sensor for this purpose. The sensor 112 may receive the blink pattern and also the position in the scene.

FIG. 1 illustrates an area of capture 113 of the sensor 112 of the mobile device 110. The mobile device 110 is pointed towards the target device 120 so that the area of capture 113 includes the position of the IR light emitter 121.

The connection system 111 may receive the blink pattern emitted by the IR light emitter 121 and identify the target device 120 from the blink pattern enabling wireless connection 113, 123 and data sharing between the mobile device 110 and the target device 120.

Figure 2:
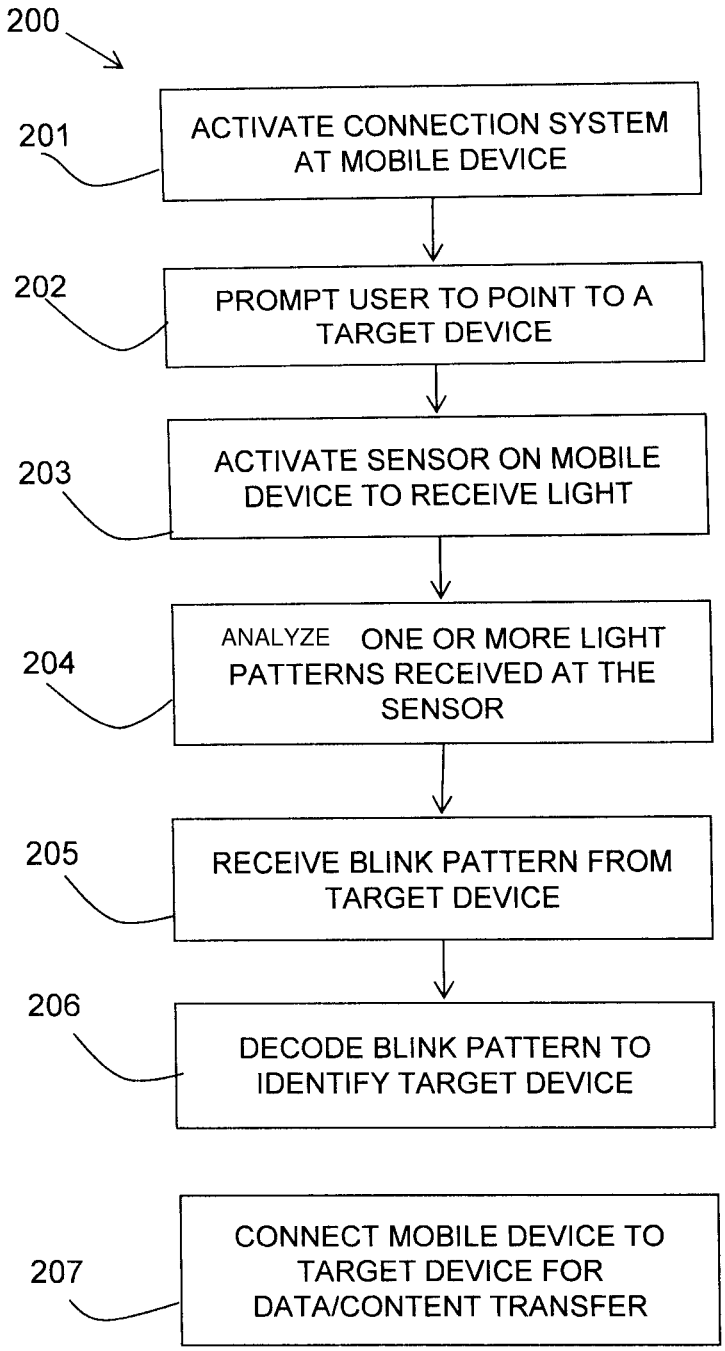
FIG. 2 is a flow diagram of an example embodiment of a method in accordance with the present invention.

Referring to FIG. 2, a flow diagram 200 shows an example embodiment of the described method as carried out at a mobile device. A user of the mobile device may activate 201 an application or system to connect to a target device in order to share data or content wirelessly.

The application provided on the mobile device may prompt 202 a user to point at a target device to which the mobile device is to be connected via a wireless connection.

A sensor of the mobile device may be activated 203. The sensor may obtain a 2D image of the area pointed to by the mobile device. The received light at the sensor may be analyzed 204 to identify an IR light emitter of a target device. The analysis 204 may include applying a filter to the received light to remove any non-IR data from the raw data and to enhance the IR light received.

If there are multiple possible target devices with IR light emitters, further analysis 203 may distinguish the actual target device's position in the area of the image. For example, if multiple targets are in view then the light source closest to the centre of the image may be selected. This provides the system with some finesse when selecting targets in a tightly packed environment. Other details of further analysis are described below.

A blink pattern may be received 205 from the intended target device and decoded 206 to reference the target device.

The target device may then be connected to 207 by the mobile device using the reference for the target device for subsequent wireless communication of content to the target device.

Figure 3:
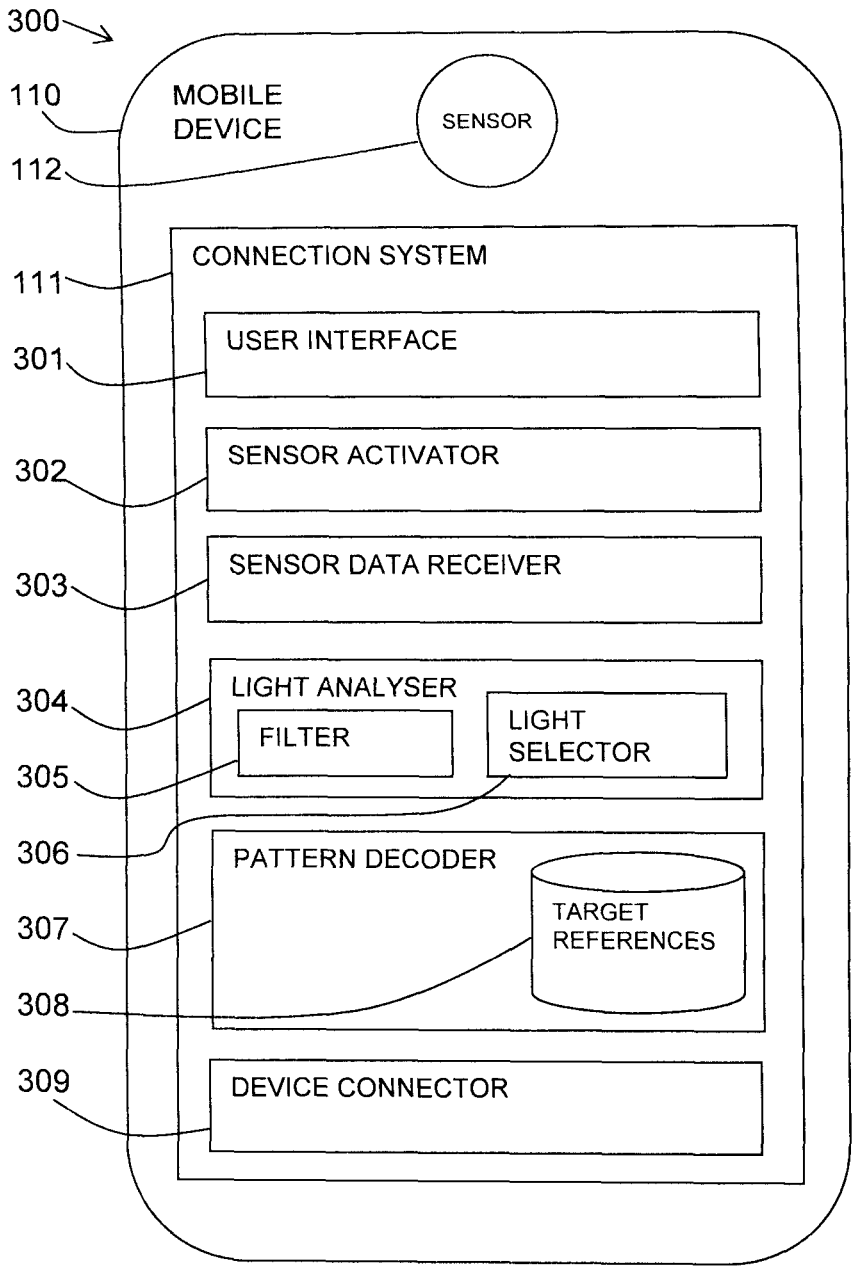
FIG. 3 is a block diagram of an example embodiment of a system in accordance with the present invention.

Referring to FIG. 3, a block diagram 300 shows an example embodiment of the described system.

A connection system 111 may be provided for a mobile device 110. The mobile device 110 may have a sensor 112 in the form of an existing camera sensor or a separate dedicated sensor. The sensor 112 may be capable of sensing IR light emitted by another device and for sensing a blink pattern of the IR light. The sensor 112 in the form of a dedicated sensor may have a built in filter to accurately isolate an IR light emission.

The connection system 111 may include a user interface 301 for providing alerts and instructions to a user and for allowing a user to input settings. A sensor activator 302 may be provided in the connection system 111 to activate the sensor 112 in order to attempt to identify and connect wirelessly to a target device.

A sensor data receiver 303 of the connection system 111 may receive data from the sensor 112 relating to light emissions it has picked up. A light analyzer 304 may be provided to analyze the light emissions picked up by the sensor 112. The light analyzer 304 may include a filter 305 for enhancing the IR light and a light selector 306 for selecting a light emitter from multiple sensed emitters.

The connection system 111 may also include a pattern decoder 307 for analyzing and decoding the blink pattern contained in the received IR light data and associating the blink pattern with a reference ID for the target device. Target reference IDs and the associated blink patterns may be stored in a storage module 308.

The connection system 111 may also include a device connector 309 for connecting wirelessly with a target device using a target reference ID.

Figure 4:
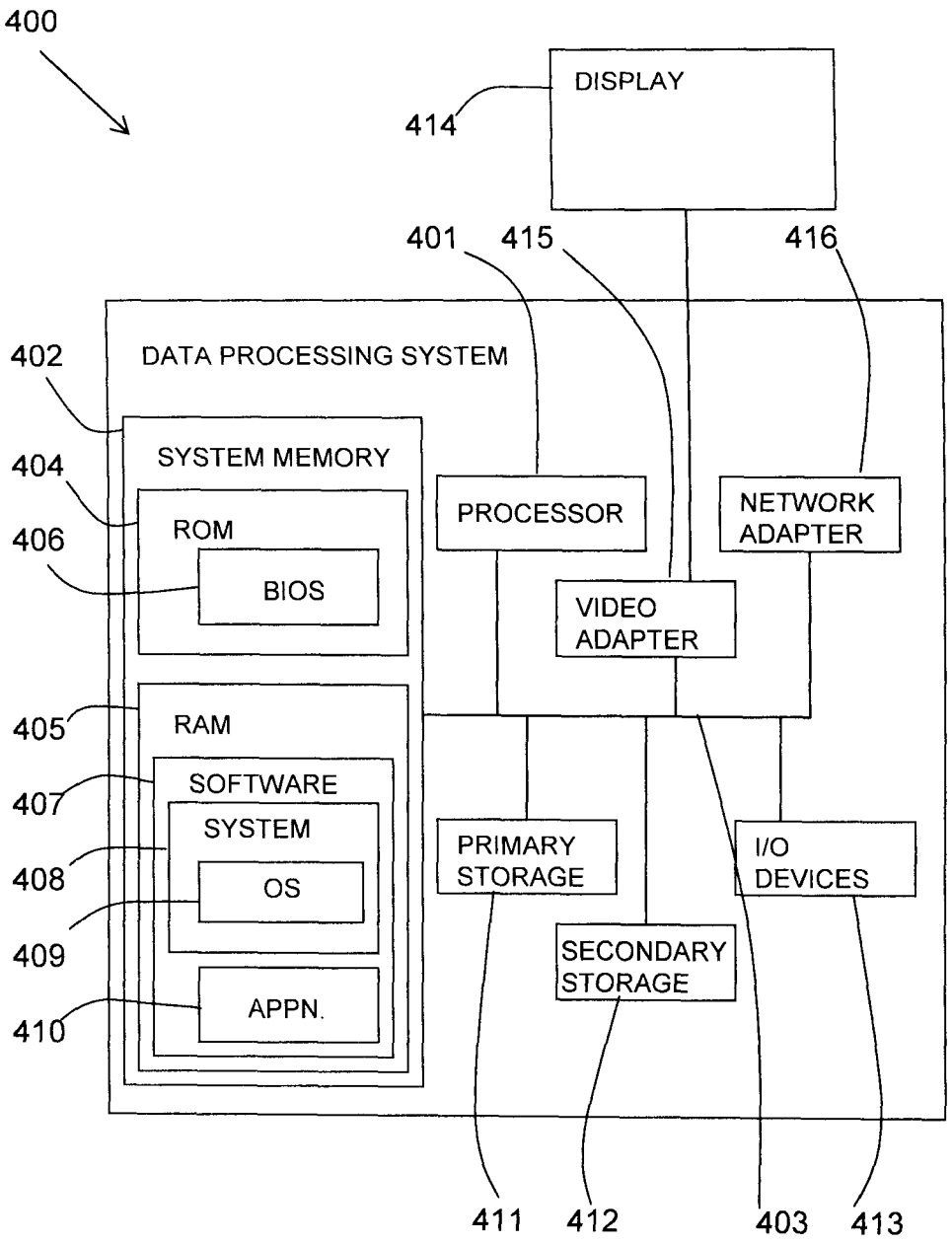
FIG. 4 is a block diagram of an embodiment of a computer system in which the present invention may be implemented.

Referring to FIG. 4, an exemplary system for implementing aspects of the invention includes a data processing system 400 suitable for storing and/or executing program code including at least one processor 401 coupled directly or indirectly to memory elements through a bus system 403. The memory elements may include local memory employed during actual execution of the program code, bulk storage, and cache memories which provide temporary storage of at least some program code in order to reduce the number of times code must be retrieved from bulk storage during execution.

The memory elements may include system memory 402 in the form of read only memory (ROM) 404 and random access memory (RAM) 405. A basic input/output system (BIOS) 406 may be stored in ROM 404. System software 407 may be stored in RAM 405 including operating system software 408. Software applications 410 may also be stored in RAM 405.

The system 400 may also include a primary storage means 411 such as a magnetic hard disk drive and secondary storage means 412 such as a magnetic disc drive and an optical disc drive. The drives and their associated computer-readable media provide non-volatile storage of computer-executable instructions, data structures, program modules and other data for the system 400. Software applications may be stored on the primary and secondary storage means 411, 412 as well as the system memory 402.

The computing system 400 may operate in a networked environment using logical connections to one or more remote computers via a network adapter 416.

Input/output devices 413 may be coupled to the system either directly or through intervening I/O controllers. A user may enter commands and information into the system 400 through input devices such as a keyboard, pointing device, or other input devices (for example, microphone, joy stick, game pad, satellite dish, scanner, or the like). Output devices may include speakers, printers, etc. A display device 414 is also connected to system bus 403 via an interface, such as video adapter 415.

In a confined space (for example, a living room), there may be many devices (TV, HiFi, etc.) in close proximity. A sensor is therefore required that can see IR sources with high directional finesse which is provided by a digital camera using a charge-coupled device (CCD) or complementary metal-oxide-semiconductor (CMOS) sensor, commonly found on most mobile devices. A digital camera's field of view is much smaller than a traditional IR port, and the x,y coordinates of an IR source can be determined in the image of a scene. This means that if multiple IR sources are visible, in it is possible to determine which one is closest to the centre of the image and therefore the intended target.

In the described method and system, the IR source is blinking, therefore a number of frames may have to be sampled and aggregated to make sure that all the IR sources in the scene have been seen. An IR source is considered to be the same as one in the previous frame(s) if it is within a given radius of its last known position. The radius may grow with the amount of time that has passed since the IR source was last seen.

Figure 5:
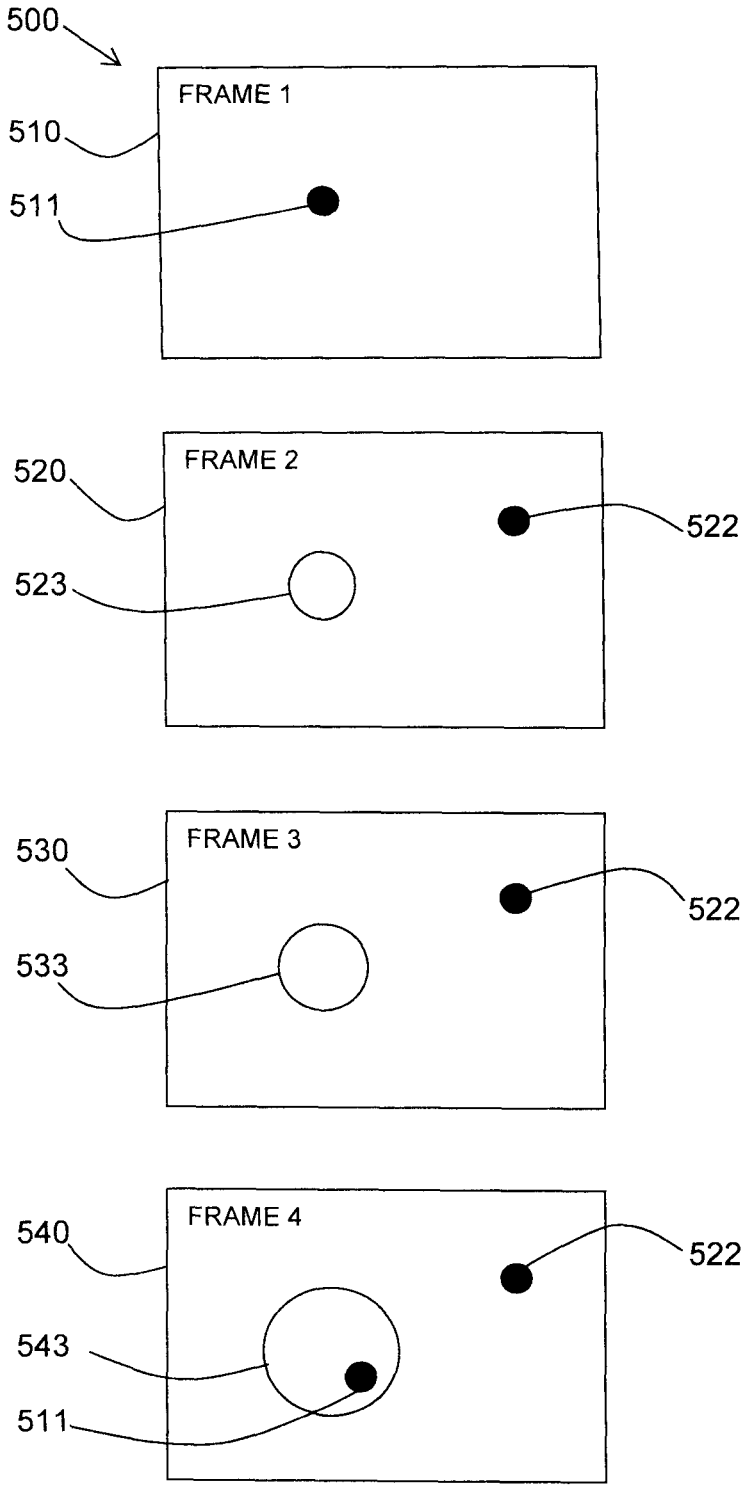
FIG. 5 is a schematic diagram of an example embodiment of an aspect of a method in accordance with the present invention.

This is illustrated in FIG. 5, which shows a schematic diagram 500 of four frames 510, 520, 530, 540 captured by a mobile device's sensor.

In frame 1 510, a first IR source 511 is captured. In frame 2 520, a second IR source 522 is captured but the first IR source 511 is not captured. A circle 523 is recorded with a radius calculated from the position of the first IR source 511 in frame 1 510. In frame 3 530, the second IR source 522 is also captured but the first IR source 511 is still not captured. A larger circle 533 is recorded with a greater radius calculated from the position of the first IR source 511 in frame 1 510.

In frame 4 540, the second IR source 522 is captured as well as another IR source which is determined to be the first IR source 511. The IR source is determined to be the first IR source 511 as it is within a yet greater circle 543 with an increased radius from the position of the first IR source 511 in frame 1 510.

A camera capturing video will typically sample at about 30 Hz. Therefore, if the IR source of a target device blinks faster than 30 Hz, some of its transmission may be missed. An optimum rate of transmission of 15-20 Hz may be provided to avoid any errors from being out of synchronization with the camera's sampling. There may also be some buffer bits in the message so that the start of the message can be identified. This reduces the bit rate for data transfer from tens of thousands of bits per second with traditional high frequency IR, to just tens of bits per second. This means that if a connectable device with the ID: "Tonys_TV" were to broadcast its ID in ASCII via IR at 20 Hz to a camera it would take more than 3 seconds to receive the full ID ((8 bits per char×8 chars)/20 Hz) which is longer than a user would wish to wait.

The described method enables a target device to broadcast a low frequency IR blink pattern that a mobile device can receive through a camera and use to uniquely identify the connectable target device, so that it knows precisely which, out of many connectable devices, it is pointing at. The IR blink pattern should take no more than a second for the camera to receive so that the information can be transferred in a timely fashion.

The target device may use a scheme for delivering a blink pattern with enough possible variations, such that each device can have a unique pattern with regards to the set of connectable devices in the area. The scheme should use a minimal number of bits so that to observe an entire blink pattern takes less than a second. Also it should not allow too many consecutive zero bits because this would mean that the IR source would be off for long periods and make it harder to identify/track in the camera's view.

An example scheme, is as follows:

12 Bit loop

Bits 0, 1, 2, 3—Always 1110 (start of loop for reference)

Bits 4, 5, 6—Binary number 1-6

Bit 7—Always 0 (end of number)

Bits 8, 9, 10—Binary number 1-6

Bits 11—Always 0 (end of number).

Example codes:

| | | |
|---|---|---|
| 1110 | 1010 | 1010 |
| 1110 | 0100 | 1100 |
| 1110 | 1000 | 1000 |

This scheme completes in under a second at 15 Hz, has a way of identifying the start and never has more than 5 zero bits in a row. If the IR source cannot be seen for too many frames/bits, it becomes harder to track. It has 36 unique codes which should be sufficient since it is unlikely that there would be 36 connectable devices in one small area.

The blink pattern is correlated to a target device ID. In one embodiment, the protocol that the target devices use to allow things to connect to them (e.g. Bluetooth) is required to be modified. These protocols typically have a mechanism by which a connectable device can broadcast details about itself (name, ID, MAC address, etc.), which a mobile device can then use to connect to it. By modifying the protocol it would be possible to add information about what blink pattern the connectable device is currently using thus allowing the mobile device to correlate an observed blink pattern with a connectable device in the area and then connect to it.

To ensure no two target devices use the same blink pattern, a command may be added to the connection protocol to allow a mobile device to request that a connectable device change its blink pattern. This would mean that, if two target devices in a scanning range were both using the same blink pattern, as the user activates "point to connect" mode on mobile device, the device could quickly scan the connection protocol, spot they were both using the same blink pattern, and tell one of them to change to another pattern before it used its camera to scan for IR sources. It would be useful if the interface for this not only allows mobile devices to request changes blink pattern but to also provide information about blink patterns that it knows are in use.

Mobile device A is in range of connectable devices 1, 2 and 3. A uses the connection protocol's ID packet to see that the connectable devices are using the following blink patterns:

1 using pattern X 2 using pattern Y 3 using pattern X

"A" may then tell 3 to change its pattern to something other than X or Y.

3 may then change to another blink pattern, (not X or Y) e.g. Z.

The blink patterns in this system are now unique and A can tell the user to "point to connect".

A possible variation of this technology would be for the mobile devices to tell ALL connectable devices in range, what blink pattern to use. A mobile device would only do this as it enters "point to connect" mode. Using this method, connectable devices would only have to blink their IR sources when requested by a mobile device that wishes to use it to identify them reducing the amount of "IR pollution" from the devices.

Since the LED is IR and outside the human visual range, it does not spoil the aesthetics of the target device. The LED would blink in a pattern unique to the target device.

Higher frequency sensors for digital cameras with very high frame rates may be provided in a mobile device in which case a higher frequency IR light emitter may be used to communicate larger volumes of data in the required time whilst still determining the source's position in the scene.

According to a first aspect of the present invention there is provided a method for target identification for a connectable device, wherein the method is carried out at a mobile device and the method comprising: receiving via a sensor one or more infrared emissions from one or more infrared light sources, each light source being provided by a connectable device in an area; analyzing the one or more infrared emissions to determine a target connectable device at a target position in the area; receiving a blink pattern of infrared emissions from the target connectable device; decoding the blink pattern to determine a reference for the target connectable device to enable wireless connection by the mobile device to the target connectable device for data transfer.

The step of analyzing the one or more infrared emissions may include filtering a received image to filter the received infrared emissions in the image. The step of analyzing the one or more infrared emissions may also include selecting an infrared emission closest to a centre of a received image.

The method may include activating a connection process and prompting a user to point the mobile device at the target connectable device.

The step of receiving via a sensor may receive an image captured by a camera of the mobile device and may receive a sampling of multiple frames at regular intervals.

An infrared source may be determined to be the same source if it appears in multiple frames within a circle of increasing radius in each frame.

The blink pattern may be transmitted at a frequency less than or equal to the sample rate of the sensor. The blink pattern may also include some buffer bits to identify the start of the blink pattern.

The blink pattern may be an encoding of the connectable device's identifier or a pattern referenced to the connectable device.

A group of connectable devices in a given location may have a set of unique blink patterns.

The method may include receiving a broadcast protocol of a connectable device including a blink pattern.

The method may further include instructing a connectable device to change its blink pattern.

According to a second aspect of the present invention there is provided a system for target identification for a connectable device, wherein the system is provided at a mobile device, comprising: a sensor for receiving one or more infrared emissions from one or more infrared light sources, each light source being provided by a connectable device in an area; a light analyzer for analyzing the one or more infrared emissions to determine a target connectable device at a target position in the area; a sensor data receiver for receiving a blink pattern of infrared emissions from the target connectable device; a pattern decoder for decoding the blink pattern to determine a reference for the target connectable device to enable wireless connection by the mobile device to the target connectable device for data transfer.

The system may include at least one target device having an infra-red light source for transmitting a blink pattern which references the target device for wireless connection by the mobile device.

The light analyzer for analyzing the one or more infrared emissions may include a filter for filtering a received image to filter the received infrared emissions in the image. The light analyzer for analyzing the one or more infrared emissions may also include a light selector for selecting an infrared emission closest to a centre of a received image.

The system may include a user interface for activating a connection process and prompting a user to point the mobile device at the target connectable device.

The sensor may be a camera of the mobile device. The sensor data receiver may receive a sampling of multiple frames at regular intervals. The sensor data receiver may determine an infrared source to be the same source if it appears in multiple frames within a circle of increasing radius in each frame.

According to a third aspect of the present invention there is provided a computer program product for a mobile device for target identification for a connectable device, the computer program product comprising: a computer readable storage medium readable by a processing circuit and storing instructions for execution by the processing circuit for performing a method according to the first aspect of the present invention.

According to a fourth aspect of the present invention there is provided a computer program stored on a computer readable medium and loadable into the internal memory of a digital computer, comprising software code portions, when said program is run on a computer, for performing the method of the first aspect of the present invention.

The described aspects of the invention provide the advantage of identifying the intended target of data shared from a mobile device by pointing the mobile device at the target device. The described invention also provides the advantage of enabling flexibility of the connection identifier.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A method for target identification for a connectable device, wherein the method is carried out at a mobile device and the method comprises:

receiving, via a sensor on a mobile device, a sampling of multiple frames of an image of an area, the sampling comprising infrared emissions from multiple infrared light sources, each infrared light source being provided by a connectable device in the area of multiple connectable devices in the area;

analyzing, by one or more processors in the mobile device, the multiple frames to select infrared emissions of a target connectable device at a target position in the area from the multiple connectable devices in the area, the selecting comprising:

ascertaining the target connectable device as the connectable device in the area producing infrared emissions closest to a center of the image over the multiple frames, wherein a same infrared light source is identified by infrared emissions occurring in more than one frame of the multiple frames within a correlation circle of increasing radius with successive frames of the multiple frames from an infrared emission closest to the center of the image;

based on the selecting, receiving, by the mobile device, a blink pattern of infrared emissions from the target connectable device; and decoding, by one or more processors in the mobile device, the blink pattern to determine a reference for the target connectable device to enable wireless connection by the mobile device to the target connectable device for data transfer.

2. The method as claimed in claim 1, wherein analyzing the one or more infrared emissions comprises filtering the image to filter received infrared emissions in the image.

3. The method as claimed in claim 1, further comprising:

activating, by the mobile device, a connection process with the target connectable device; and prompting, by the mobile device, a user to point the mobile device at the target connectable device.

4. The method as claimed in claim 1, wherein receiving the infrared emissions of the sampling via the sensor on the mobile device comprises:

receiving the image via a camera of the mobile device.

5. The method as claimed in claim 1, wherein the sampling of multiple frames of the image comprises frames at regular intervals.

6. The method as claimed in claim 1, further comprising:

transmitting, by the mobile device, the blink pattern at a frequency less than or equal to a sampling rate of the sensor on the mobile device.

7. The method as claimed in claim 1, wherein the blink pattern includes buffer bits that identify a start of the blink pattern.

8. The method as claimed in claim 1, wherein the blink pattern is an encoding of an identifier of the target connectable device.

9. The method as claimed in claim 1, wherein the blink pattern is an encoding of a pattern referenced to the target connectable device.

10. The method as claimed in claim 1, wherein the multiple connectable devices in the area have unique blink patterns.

11. The method as claimed in claim 1, wherein the receiving, based on the selecting, comprises:

receiving, by the mobile device, a broadcast protocol for the target connectable device, wherein the broadcast protocol comprises the blink pattern.

12. The method as claimed in claim 1, further comprising:

prior to receiving the sampling of multiple frames, instructing, by the mobile device, a connectable device of the multiple connectable devices in the area to change its blink pattern.

13. A system for target identification for a connectable device, wherein the system is provided at a mobile device, the system comprising:

a sensor for receiving a sampling of multiple frames of an image of an area, the sampling comprising infrared emissions from multiple infrared light sources, each infrared light source being provided by a connectable device in the area of multiple connectable devices in the area;

a light analyzer for analyzing the multiple frames to select infrared emissions of a target connectable device at a target position in the area from the multiple connectable devices in the area, the selecting comprising:

ascertaining the target connectable device as the connectable device in the area producing infrared emissions closest to a center of the image over the multiple frames, wherein a same infrared light source is identified by infrared emissions occurring in more than one frame of the multiple frames within a correlation circle of increasing radius with successive frames of the multiple frames from an infrared emission closest to the center of the image;

a sensor data receiver for receiving, based on the selecting, a blink pattern of infrared emissions from the target connectable device; and a pattern decoder for decoding the blink pattern to determine a reference for the target connectable device to enable wireless connection by the mobile device to the target connectable device for data transfer.

14. The system as claimed in claim 13, wherein the light analyzer for analyzing the one or more infrared emissions includes a filter for filtering the image comprising the received infrared emissions.

15. The system as claimed in claim 13, further comprising:

a user interface for activating a connection process and prompting a user to point the mobile device at the target connectable device.

16. A computer program product for target identification for a connectable device on a mobile device, the computer program product comprising a computer readable storage medium having program code embodied therewith, wherein the computer readable storage medium is not a transitory signal per se, and wherein the program code is readable and executable by a processor to perform a method comprising:

receiving, via a sensor on a mobile device, a sampling of multiple frames of an image of an area, the sampling comprising infrared emissions from multiple infrared light sources, each infrared light source being provided by a connectable device in the area of multiple connectable devices in the area;

analyzing, by one or more processors in the mobile device, the multiple frames to select infrared emissions of a target connectable device at a target position in the area from the multiple connectable devices in the area, the selecting comprising:

ascertaining the target connectable device as the connectable device in the area producing infrared emissions closest to a center of the image over the multiple frames, wherein a same infrared light source is identified by infrared emissions occurring in more than one frame of the multiple frames within a correlation circle of increasing radius with successive frames of the multiple frames from an infrared emission closest to the center of the image;

based on the selecting, receiving, by the mobile device, a blink pattern of infrared emissions from the target connectable device; and decoding, by one or more processors in the mobile device, the blink pattern to determine a reference for the target connectable device to enable wireless connection by the mobile device to the target connectable device for data transfer.

* * * * *